US009672700B2

(12) United States Patent
Lax

(10) Patent No.: US 9,672,700 B2
(45) Date of Patent: Jun. 6, 2017

(54) TASK LIGHTING SYSTEM WITH ALARM AND DIMMING FEATURES

(71) Applicant: Clear-vu Lighting LLC, Central Islip, NY (US)

(72) Inventor: Daniel A. Lax, Roslyn, NY (US)

( * ) Notice: Subject to any disclaimer, the term of this patent is extended or adjusted under 35 U.S.C. 154(b) by 0 days.

(21) Appl. No.: 14/776,160

(22) PCT Filed: Mar. 17, 2014

(86) PCT No.: PCT/US2014/030249
§ 371 (c)(1),
(2) Date: Sep. 14, 2015

(87) PCT Pub. No.: WO2014/145476
PCT Pub. Date: Sep. 18, 2014

(65) Prior Publication Data

US 2016/0035192 A1 Feb. 4, 2016

Related U.S. Application Data

(60) Provisional application No. 61/799,871, filed on Mar. 15, 2013.

(51) Int. Cl.

| | |
|---|---|
| ***G08B 21/00*** | (2006.01) |
| ***G08B 5/36*** | (2006.01) |
| ***G08B 5/38*** | (2006.01) |
| ***G08B 21/02*** | (2006.01) |
| *G08B 7/06* | (2006.01) |

(52) U.S. Cl.
CPC ..... *G08B 5/36* (2013.01); *G08B 5/38* (2013.01); *G08B 21/02* (2013.01); *G08B 7/06* (2013.01)

(58) Field of Classification Search
CPC ..... F21Y 2101/00; F21S 2/00
See application file for complete search history.

(56) References Cited

U.S. PATENT DOCUMENTS 5,608,375 A * 3/1997 Kosich ..... G08B 7/06 307/35
7,387,407 B2 6/2008 Tseng
(Continued)

FOREIGN PATENT DOCUMENTS

WO 2014134608 A2 9/2014

OTHER PUBLICATIONS

Oct. 28, 2016 Examination report in related application GB1514117.9.

*Primary Examiner* — Shirley Lu
(74) *Attorney, Agent, or Firm* — Zollinger & Burleson Ltd.

(57) ABSTRACT

A temporary task lighting system used on job sites has an alarm mode. The system may be used to provide an alarm indication using the light units of the system. The alarm indication may be cycling the lights through on and off conditions or full on and dimmed conditions. Different systems and methods may be used to activate the alarm. The alarm activation may come from a typical fire alarm switch, a button on the power supply, a button on a central control computer, or a signal from an emergency response system such as a 911 system. The disclosure also provides central control for remote drivers and ballasts. The central control allows different zones of low voltage lighting systems or different zones of low voltage lights to set up, identified, and individually controlled from a central interface.

19 Claims, 5 Drawing Sheets

(56) References Cited

U.S. PATENT DOCUMENTS

| | | | | |
|---|---|---|---|---|
| 7,663,898 | B2 | 2/2010 | Lindemann et al. | |
| 2004/0257789 | A1* | 12/2004 | Nielson | F21S 9/022 362/20 |
| 2005/0190078 | A1 | 9/2005 | Salter | |
| 2005/0221659 | A1 | 10/2005 | Mrakovich et al. | |
| 2007/0064450 | A1 | 3/2007 | Chiba et al. | |
| 2007/0070622 | A1 | 3/2007 | Allen | |
| 2007/0189001 | A1 | 8/2007 | Nielson et al. | |
| 2007/0222399 | A1* | 9/2007 | Bondy | F21S 2/00 315/291 |
| 2010/0148697 | A1* | 6/2010 | Bayat | F21L 4/027 315/294 |
| 2010/0296536 | A1 | 11/2010 | Tao | |
| 2012/0007516 | A1 | 1/2012 | Lax et al. | |
| 2013/0201658 | A1 | 8/2013 | Bogart et al. | |
| 2014/0320011 | A1 | 10/2014 | Hegarty | |

* cited by examiner

TASK LIGHTING SYSTEM WITH ALARM AND DIMMING FEATURES

CROSS REFERENCE TO RELATED APPLICATIONS

This application is a United States National Stage Patent Application filed under 35 U.S.C. §371 claiming priority to PCT/US2014/030249 having an international filing date of Mar. 17, 2014. This application claims the benefit of U.S. Provisional Patent Application 61/799,871 filed Mar. 15, 2013.

BACKGROUND OF THE DISCLOSURE

1. Technical Field

The following disclosure generally relates to task lighting systems and, more particularly, to LED-powered, temporary task lighting systems having an alarm mode to provide an alarm indicator to those using the lighting system. The disclosure also relates to a system and method for dimming a task lighting system.

2. Background Information

Numerous applications require temporary task lighting. One such exemplary application is a construction site wherein permanent standard-voltage hard-wired power has not yet been installed. The construction site may be a portion of a building or structure, an entire building or structure, a plurality of buildings or a plurality of structures, or an infrastructure site such as a tunnel, rail site, bridge or roadway. To light these sites, the contractor installs temporary task lighting that is usually removed at or near the completion of the project. Contractors desire task lighting options wherein multiple outlets are not required and wherein customization of both the size and locations of the light sources is possible. One example of a temporary task lighting system that satisfies these needs is described in US patent application publication 20120007516. Job sites that use temporary task light systems also need systems for alerting the workers using the system to emergency situations. Sirens and loudspeakers have been used in the past. Contractors, insurers, emergency response personnel, and project owners desire an emergency notification system that provides workers notice of an emergency situation in or around the job site.

SUMMARY OF THE DISCLOSURE

The disclosure provides a task lighting system having an alarm mode. The disclosure also provides methods for providing an alarm indication using a task lighting system and particularly using a temporary, removable task lighting system used on construction job sites where permanent power installations and permanent wiring is not yet available. The alarm indication may be cycling the lights through on and off conditions or full on and dimmed conditions.

The disclosure provides different systems and methods for communicating an alarm activation mode to a temporary task lighting system. The alarm activation may come from a typical fire alarm switch, a button on the power supply, a button on a central control computer, or a signal from an emergency response system such as a 911 system.

The disclosure provides systems and method for dimming the light modules of a task lighting system and particularly for dimming a temporary task lighting system by reducing the voltage supplied to the light modules through the low voltage power supply line that is normally used to power the light modules of the system. The light modules are configured to recognize a lower voltage condition and automatically dim in response to the condition. The dimming can be centrally control or controlled with a timer. The dimming command can be provided in a low voltage two conductor power supply and a third wire is not required.

The disclosure also provides central control for remote drivers and ballasts. The central control allows different zones of low voltage lighting systems or different zones of low voltage lights to set up, identified, and individually controlled from a central interface. This reduces the cost of networking components by controlling entire lighting systems having a plurality of lighting modules with a single networking module instead of requiring an individual networking module on each lighting module.

The individual features of this disclosure may be combined to form different configurations used in combinations than the exemplary configurations

DRAWINGS

Simile numbers refer to similar parts throughout the specification.

DETAILED DESCRIPTION OF THE DISCLOSURE

The disclosure provides a temporary task lighting system having an alarm mode, a dimming mode, or both; with related methods for each. In the configurations having the alarm mode, when the alarm is activated, the lamps of the task lighting system are cycled on and off (or are cycled between full power and dimmed mode) to provide an alert that an alarm has been activated. Various cycle rates may be used and one example is a cycle rate of three to four seconds in each mode to provide an indication of an alarm condition to those viewing the light provided by the task lighting system. In the configurations having the dimming mode, the light modules of the system are changed to a dimmed mode when the voltage in the power supply line is reduced.

Figure 1:
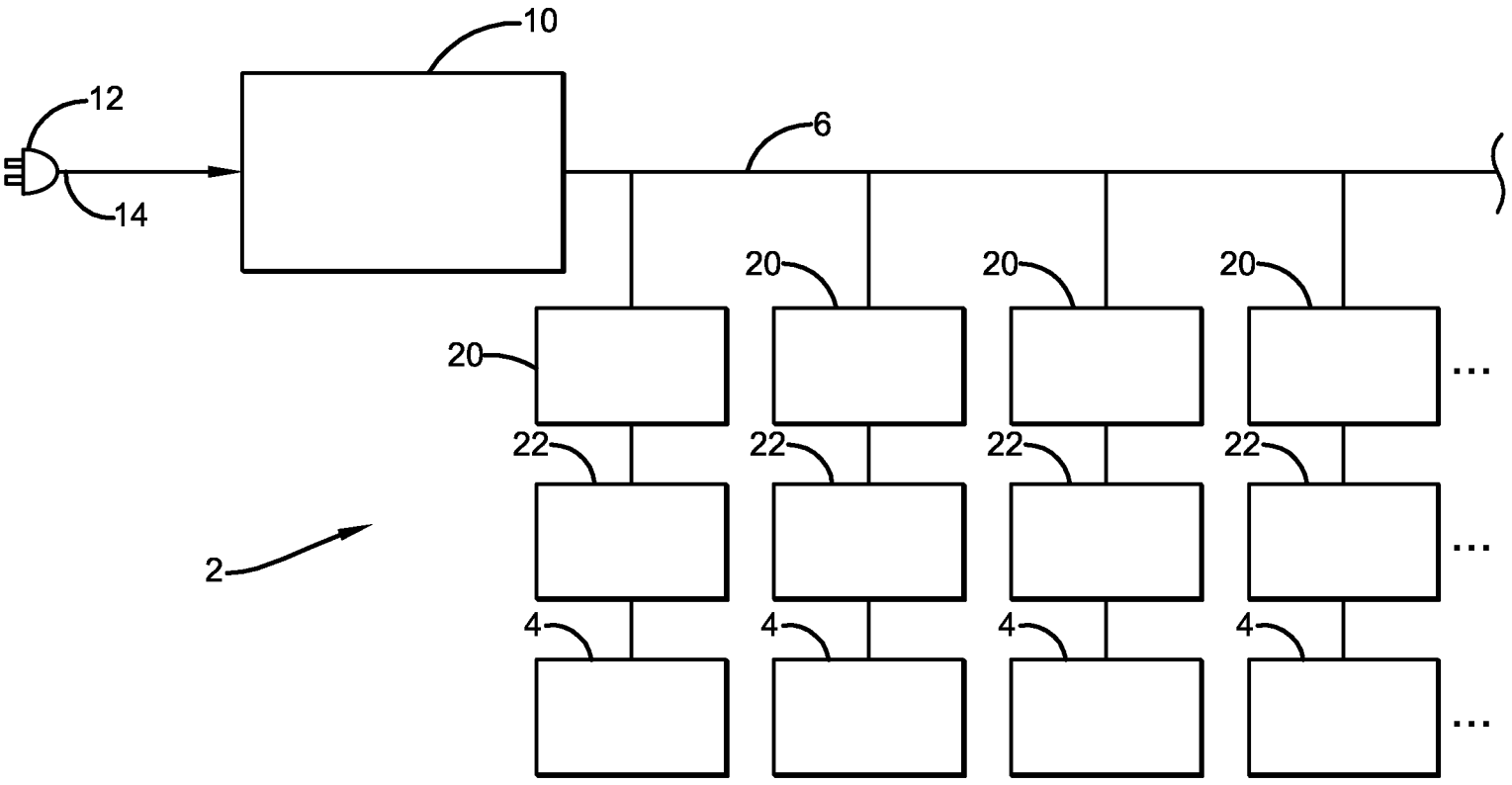
FIG. 1 PRIOR ART
FIG. 1 is a schematic of a prior art task lighting system having LED light modules.

An example of a task lighting subsystem 2 that may be provided with the alarm or dimming features of this disclosure is disclosed in US patent application publication 20120007516, the disclosure of which is incorporated herein by reference. FIG. 1 depicts an example of subsystem 2 which includes light modules 4 disposed along a low voltage power supply line 6 to provide task lighting to the area wherein subsystem 2 is installed. Any of a variety of light modules 4 may be used. For example, the user may install large and small light modules 4, different color light modules 4, light modules 4 having different shapes, or light modules 4 of differing lumen output at the different locations along low voltage power supply line 6. LED light modules may be provided with high-output LED light engines that output about 800 lumens to 6500 lumens and are suitable for task lighting. A 2000 lumen light module 4 may be used. Light modules 4 may be unevenly spaced along low voltage power supply line 6 as desired.

Task lighting subsystem 2 generally includes a low voltage direct current power supply 10 that transforms the alternating current from commonly available electrical power sources (such as 95V or 110V or 220V line voltage) to a low voltage direct current power supply available in low voltage power supply line 6 (such as a 21V to 30V direct current supply). Power supply 10 may include a plug 12 that allows subsystem 2 to be plugged into a standard alternating current line power source 14. Power source 14 also may be hardwired without plug 12. Subsystem 2 may be configured to function with a range of input line power voltages such as from 90V to 277V and to accommodate power surges. In the exemplary configuration, power supply 10 outputs a 22V to 28V to low voltage power supply line 6. Power supply 10 may support multiple independent low voltage power supply lines 6 such that lines 6 may extend in different directions from power supply 10. Power supply 10 may be a 450 W supply with a 90-265 VAC input with an output of 24 VDC (22-28 VDC) that may be used to energize up to sixteen modules 4 on a single low voltage power supply line 6. Power supply 10 may be provided by Mean Well USA, Inc. of Fremont, Calif. Low voltage power supply line 6 may be provided in relatively long lengths (over 100 feet in length). Only two conductors are required in power supply line 6 although a third conductor may be used in some configurations to provide communication signals or to function as a ground wire.

Each light module 4 is connected to low voltage power supply line 6 with a connector 20 that forms an electrical connection with low voltage power supply line 6. Connector 20 may be configured to form the electrical connection with low voltage power supply line 6 without the use of tools such that the user may simply snap, press, thread, or clamp connector 20 onto low voltage power supply line 6 at a desired location. A T-splice connector may be used. Connector 20 may include teeth or leads that cut through the insulation of low voltage bus line 6 to form the electrical connection. In other configurations, connector 20 may require areas of low voltage bus line 6 to be stripped to expose the conductor. In further configurations, connector 20 may be in the form of a junction box or socket that allows a connection to be readily formed. A rectifier 22 may be provided as shown in FIG. 1.

When in combination with the features described below, subsystem 2 does not require connector 20 as light modules 4 may be directly wired to low voltage power supply line 6. Also, line 6 may be rectified prior to the location of light module 4 and rectifier 22 is not a necessary component to subsystem.

The disclosure provides a lighting system 100 that includes at least the basic components of one task lighting subsystem 2 in combination with at least one alarm feature that provides an alarm indicator to a location. In response to an alarm signal, task lighting subsystem 2 provides the indication to the worker that an alarm condition has occurred at or near the location. The indication provided by system 100 is the flashing of the light modules of subsystem 3 or the cycling of module 4 between full power and dimmed conditions. The location may be a construction site such as a portion of a building or structure, an entire building or structure, a plurality of buildings or a plurality of structures, or an infrastructure site such as a tunnel, rail site, bridge or roadway.

Figure 4:
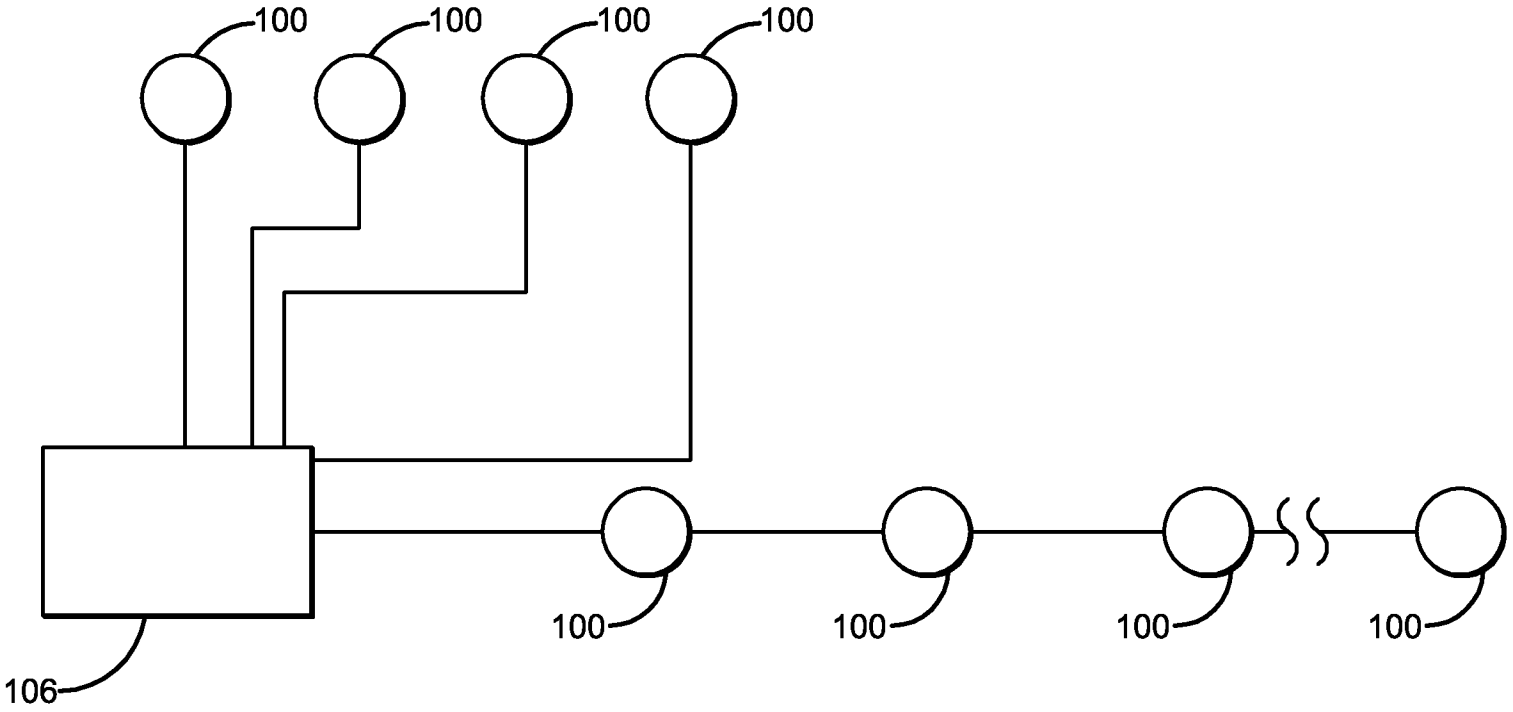
FIG. 4 is a schematic of a network of task lighting systems controlled by a central controller.

The alarm signal provided to subsystem 2 may be provided from an alarm switch 102, an alarm controller 104 connected to one or a plurality of alarm switches 102, a computer 106 (which may be a computer located on-site, a remote computer operated by a private entity, or a remote computer operated by an emergency response system such as a 911 system). Computer 106 may be a personal computer having a CPU, memory, an input device, and a screen. Software on computer 106 monitors the condition of system 100 and provides information about the current and historical conditions of system 100. As shown in FIG. 4, computer 106 can be used to selectively control systems 100 and the software may be configured to allow the user to control different groups of systems 100. These different mechanisms provide different systems and methods for activating the alarm mode of subsystems 2.

Figure 5:
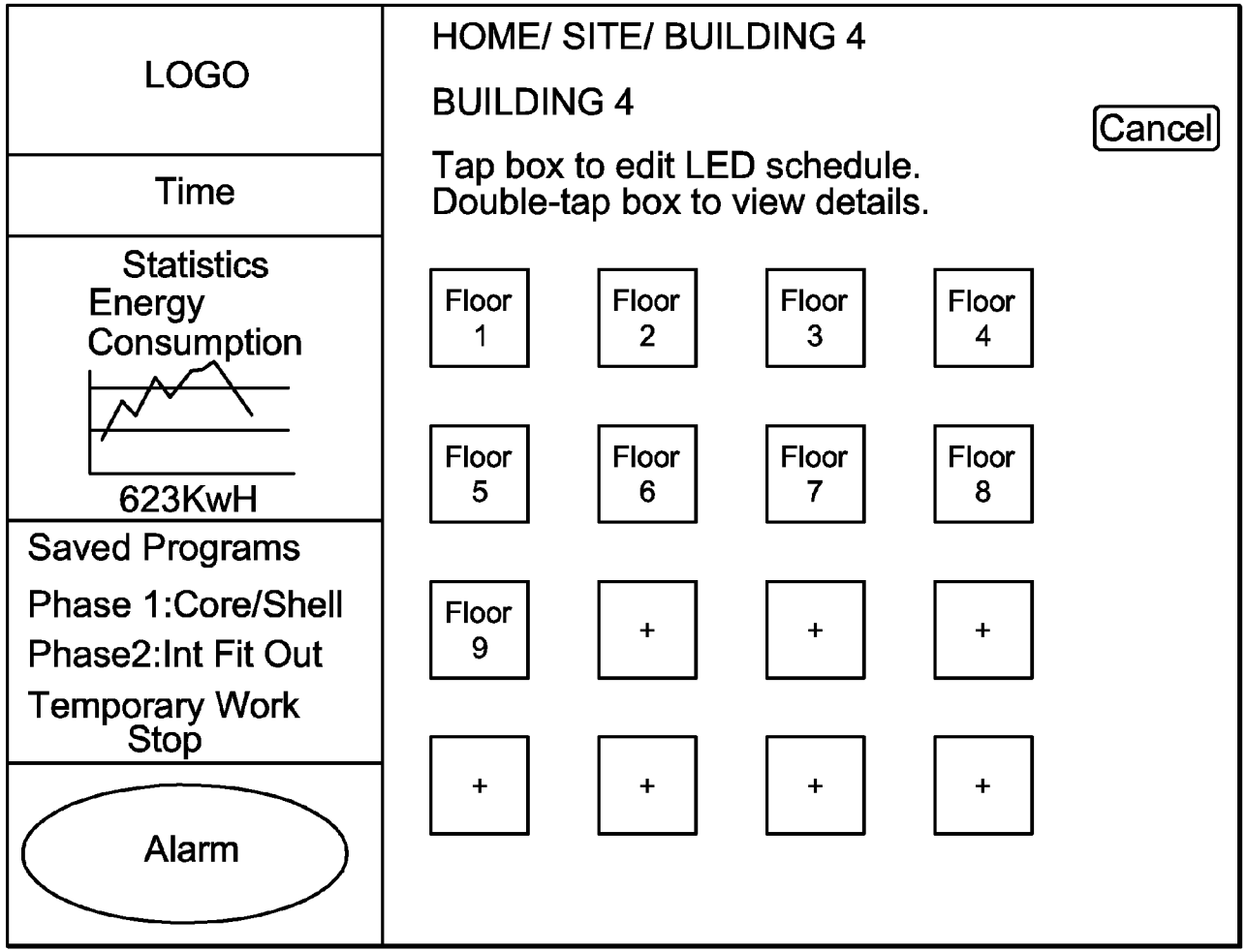
FIG. 5 is an exemplary screen of a central controller.

FIG. 5 depicts an example screen displayed by computer 106. In this example, the screen depicts different floors of a building and the status of systems 100 associated with those floors. Systems 100 associated with those floors may be controlled by computer 106. An alarm function is provided on this screen to allow the user to send an alarm instruction to all or a portion of systems 100 controlled by computer 106. This screen also allows the user to view statistics such as power usage for one floor at a time or the entire system. The overall system may thus divide a building or construction site into individually controlled sections that are each controllable and monitorable by a central computer. A single communications module such as a network communications device may provide the communication to an entire section of the overall system which allows a plurality of light modules to be controlled with a single communications or network module.

Figure 2:
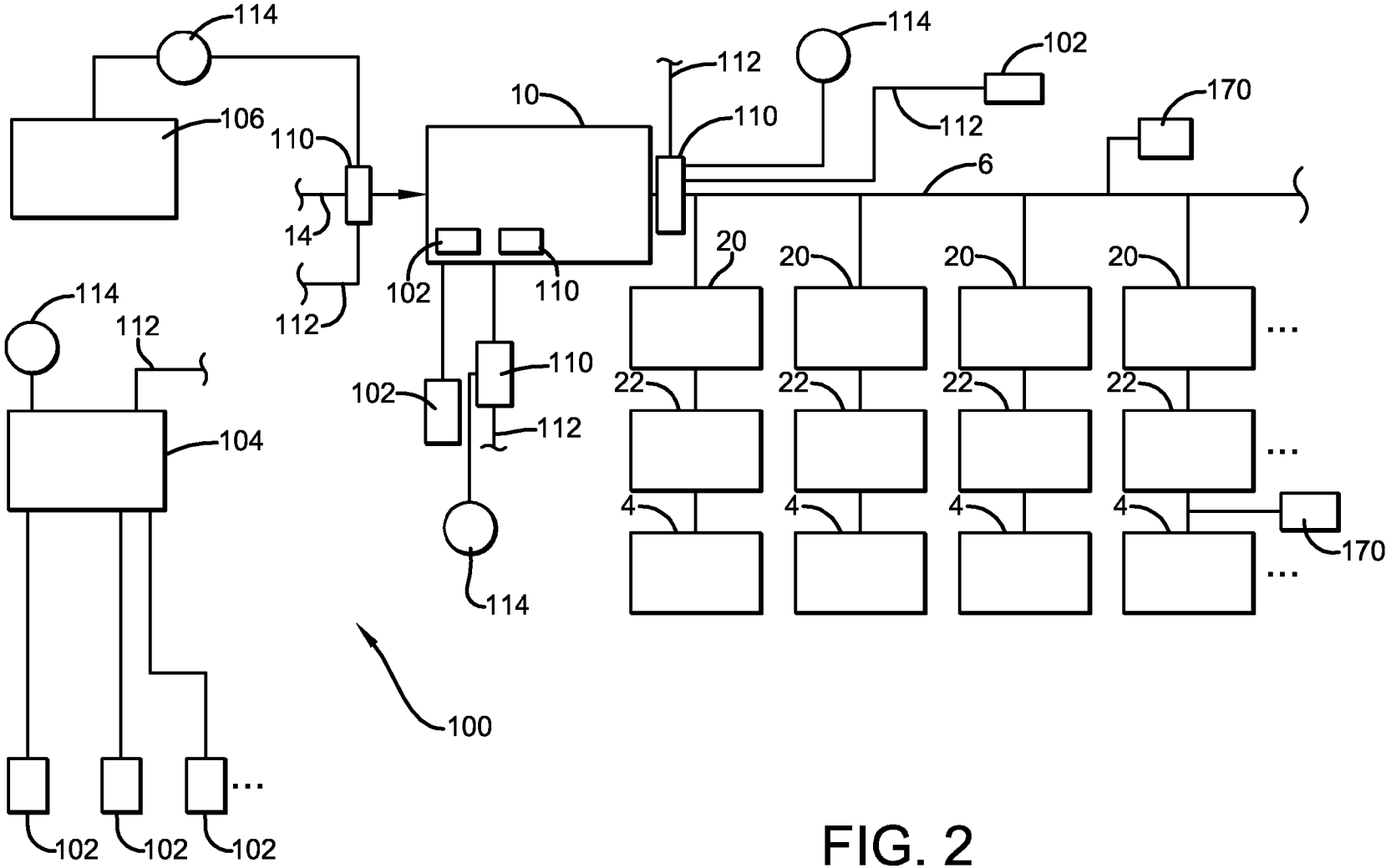
FIG. 2 is a schematic of different configurations of the system of the disclosure wherein an alarm switch is in communication with a task lighting system and the task lighting system is used as an alarm indicator.

In one configuration, system 100 includes at least one alarm switch 102 or a plurality of alarm switches 102 distributed about a location. The alarm switch 102 may be located remote from the elements of subsystem 2 or as a part of subsystem 2 such as an alarm switch 102 disposed on or connected to power supply 10. In one configuration, each alarm switch 102 is in communication with an alarm controller 104 that monitors that status of each alarm switch 102. If an alarm switch 102 is activated, the alarm controller 104 provides an instruction or instructions to an alarm module 110 that activates the alarm indicator adapted to inform people that an alarm switch has been pulled. The alarm instruction is delivered to the alarm module 110 through a hard wire connector 112, a connection through a computer network 114, or by way of a wireless signal. The connector 112 may be an independent dedicated alarm connector wire 112 or a multi-purpose connector such as the power line 14 that supplies power to the alarm indicator. The wireless signal may be a radio frequency signal delivered by any of a variety of wireless communication protocols. FIG. 2 depicts a plurality of alternative positions for alarm module 110 including combined with power supply 10, on the high voltage side of power supply 10, on the low voltage side of power supply 10, or connected as an independent module to power supply 10.

Regardless of the location of alarm switch 102, when alarm switch 102 is activated, an alarm instruction is generated and delivered to alarm module 110. In response to the alarm instructions, alarm module 110 changes the condition of the light modules 4 which are controlled by the power supply associated with alarm module 110 to provide an alarm indication. The change in condition may be flashing light modules 4 between on and off conditions or cycling light modules 4 between a full power mode and dimmed mode.

In one configuration, connector 112 between alarm switch 102 and alarm module 110 is a wire and the signal can be a low voltage (such as 5 Volts) current in the wire. Alarm module 110 is configured to sense when a voltage exists in connector 112 and, in response, changes to an alarm mode where light modules are cycled.

In another configuration, each alarm switch 102 includes its own wireless communication module that sends an alarm instruction to alarm module 110. The communication module can be a wireless transmitter that transmits the alarm instruction when the alarm switch 102 is activated.

In another configuration, alarm switch 102 provides an alarm signal to alarm controller 104 which, in turn, communicates the alarm signal to alarm module 110.

In another configuration, computer 106 provides the alarm instruction to alarm module 110. Computer 106 can provide the alarm instruction through a direct wire 112, through a wireless signal, or through instructions delivered through a network of computers or wireless communication modules.

In this example of the disclosure wherein the alarm indicator is in the form of a task lighting subsystem and takes the form of cycling light modules 4, alarm module 110 includes a switch or timer that cycles the power delivered through module 110 to cause the desired cycling. Module 110 can cycle the power supplied to power supply 10 or can cycle the power delivered from power supply 10 to line 6. As explained below, a dimming mode may be provided when a low voltage condition is provided in line 6 and module 110 may cycle between the normal low voltage condition in line 6 and a lower voltage condition to achieve the dimmed mode for light modules. Other dimming mechanisms and methods also may be used for the cycling.

Figure 3:
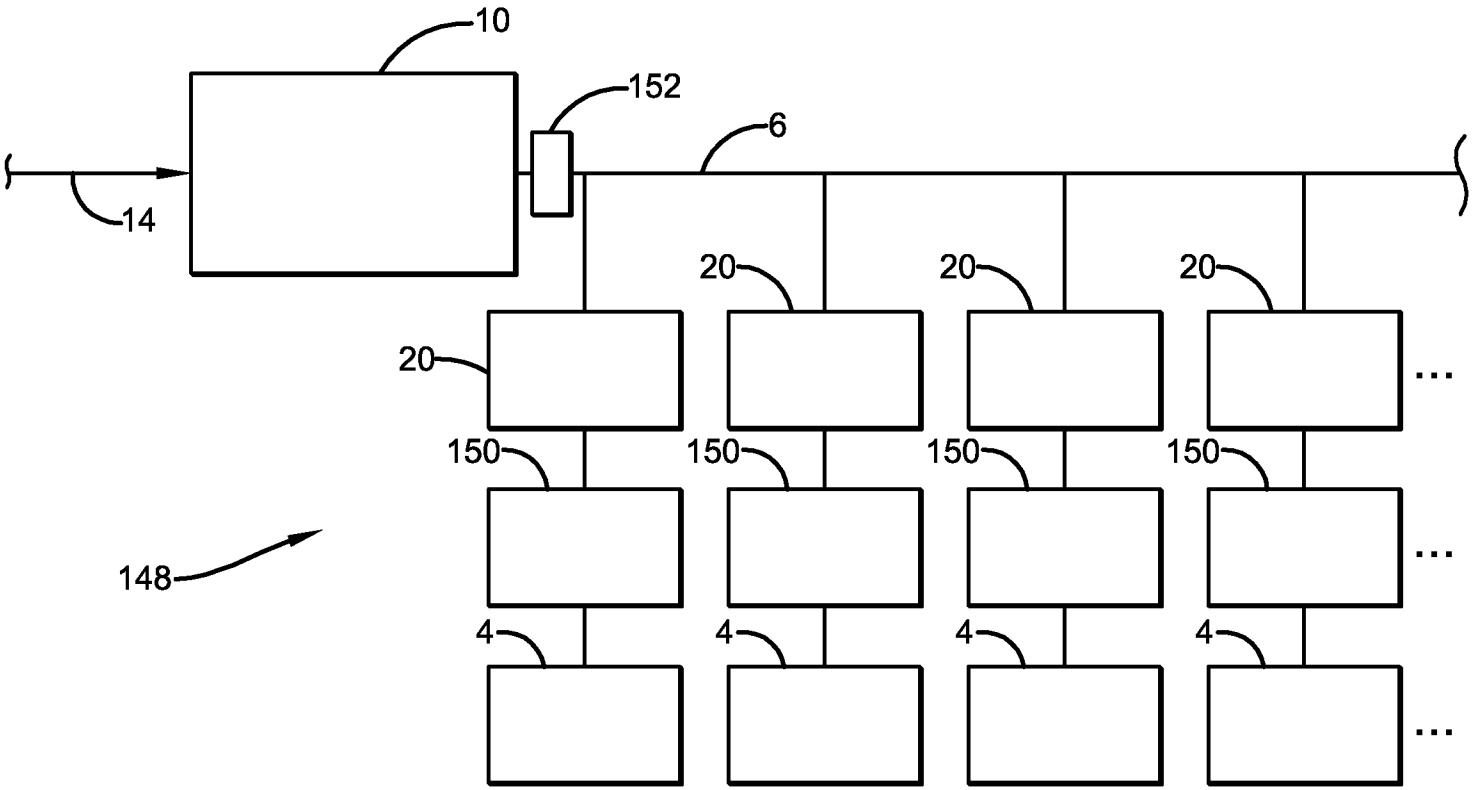
FIG. 3 is a schematic of a dimmable task lighting system wherein a low voltage condition in the power supply line activates the dimmed condition of the light modules.

The disclosure also provides a lighting system 148 having a lower power mode in low voltage power supply line 6 wherein the light modules of the system respond to the lower voltage condition and are dimmed. System 148 may be combined with system 100 having the alarm features. System 148 is schematically depicted in FIG. 3. Each light module 4 is dimmed in response to a lower voltage condition in power supply line 6 that normally supplies power to light modules 6. In a low-voltage lighting system the normal full-power mode uses a voltage of 21 to 30 Volts in the power supply line 6. The power supply line 6 may be a two conductor direct current line that supplies low voltage direct current to at least one or a plurality of LED light modules 4. Each LED light module 4 may be connected to the power supply line 6 with a splice 20. In this dimmable system, the voltage in the power supply line 6 is reduced to a value under 21 Volts and a circuit for each lamp dims the lamp in response to the reduced voltage. For example, the sensor may be a circuit 150 carried by light module 4 or electrically connected to or in communication with light module 4 and the dimming voltage may be 18.75 Volts in the power supply line 6. The circuit 150 recognizes the 18.75 Volt condition and reduces the lumen output of the light module 4. The voltage of the power in the power supply line is reduced by the power supply or a voltage regulator 152 connected to line 6. This system allows light modules 4 to be dimmed using only the two conductor power supply line 6. A third conductor is not required to achieve the dimming.

In one example, the system includes a low voltage power supply capable of converting input power from 110 to 277 Volts to a direct output power voltage of 21 to 30 Volts. The power supply may be a Mean Well direct voltage power supply 10. A switch (separate from or incorporated into voltage regulator 152) is provided on the output side of the power supply 10. This switch may be a timer. In the dim mode, the switch delivers the power to voltage regulator 152 which is capable of changing the direct current output of the power supply 10 to a voltage less than 21 Volts. The voltage regulator 152 can output 18.75 Volts for the dim mode. Each lighting module 4 connected to the power supply line 6 is associated with a circuit 150 that, in response to a voltage input less than 21 Volts (such as the 18.75 Volts), reduces the output of the light module 4. This may be accomplished to reducing the current delivered to the lamps of the light module 4. This circuit 150 may be disposed downstream of a rectifier disposed at the lighting module 4. In the alarm mode described above, the switch cycles the power between the power supply line 6 and the voltage regulator 152 causing the light modules 4 to change between the full power mode and the dim mode to provide the alarm indication.

A plurality of individual temporary task lighting systems 148 (or systems 100 with dimmable features) may be connected together or adapted to communicate with a central controller (which may be a computer) 106 as shown in FIG. 4 to form a network of task lighting systems 100. The individual systems may be connected together with wires such as CAT 5, CAT 5e, or other Ethernet cables. The individual systems may be chained together from a central controller of each of the individual systems may be connected to the central controller in a star configuration. The central controller may be used to control each of the systems. Alternatively, a wireless communication system may be used to wirelessly connect and control each system 100. For example, a ZigBee communications system may be used to communicate the alarm mode or dimming mode between the task lighting systems 100.

In one optional configuration, the task lighting system 100 may be provided with speakers 170 (see FIG. 2) to provide an audible alarm or announcements in response to the alarm instruction. The speakers 170 can be integrated with the power supply 10, can be carried by the lighting module 4 of the task lighting system, or they can be independent and powered by the power supply line 6. When speakers 170 are provided, they may be configuration and used as an intercom system or an announcement system for non-emergency situations. The speaker 170 may include a circuit that senses the cycling power in the power supply line 6 to provide an audible alarm signal. The speaker 170 may include a circuit that senses the lower dimming voltage in the power supply line 6 to provide an audible alarm signal. An optional configuration uses a radio frequency receiver to activate the speaker 170 such that a wireless signal may be used to activate an audible alarm.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration of the invention is an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. A method of providing an alarm indicator in a temporary task lighting system installed at a job site that has a plurality of LED light modules suitable for task lighting connected to and spaced along a low voltage power supply line which is powered by a low voltage power supply; the method comprising the steps of:

using the light modules for task lighting in a normal on condition; and in response to an alarm signal provided from a location remote from individual LED light modules, cycling at least a plurality of the same LED light modules of the temporary task lighting system through first and second conditions to provide an alarm indicator to those at the job site viewing the LED light modules.

2. The method of claim 1, wherein one of the first and second conditions is off.

3. The method of claim 1, wherein the second condition is dimmed compared to the first condition.

4. The method of claim 1, wherein the first condition is full power and the second condition is no power.

5. The method of claim 1, wherein the first condition is full power and the second condition is dimmed.

6. The method of claim 1, wherein the alarm signal is provided from an alarm switch.

7. The method of claim 1, further comprising the step using the cycling of the lights to initiate an audible alarm.

8. The method of claim 1, wherein the step of cycling includes the step of periodically changing the voltage supplied to the light modules.

9. The method of claim 8, further comprising the step of changing the voltage from a value above 21 volts to a value below 21 volts.

10. The method of claim 9, further comprising the step of reducing the current delivered to the light modules when the voltage is below 21 volts.

11. A temporary task lighting system having alarm mode; the system comprising:

a temporary task lighting subsystem having a low voltage power supply line and a plurality of LED light modules connected to and spaced apart along the low voltage power supply line; and a direct current power supply that supplies low voltage direct current to the low voltage power supply line;

an alarm switch that creates an alarm signal; the alarm switch being remote from the individual LED light modules; and an alarm module in communication with the alarm switch, the alarm module cycling the LED light modules between at least first and second conditions to provide an alarm indicator to those at the job site viewing the light modules.

12. The system of claim 11, wherein the alarm module includes a switch and a voltage regulator; the voltage regulator outputting a direct current voltage that is less than the output of the direct current power supply.

13. The system of claim 12, further comprising a circuit associated with a plurality of the light modules that reduces the current delivered to the light module in response to the voltage output by the alarm module.

14. The system of claim 13, wherein the direct current power supply has an output at or above 21 volts.

15. The system of claim 14, wherein the voltage regulator has an output of 18.75 volts.

16. The system of claim 11, wherein the alarm switch is carried by the power supply.

17. The system of claim 11, wherein the alarm switch is located remote from the power supply.

18. The system of claim 17, wherein the alarm switch is connected to the alarm module with a wire.

19. The system of claim 17, wherein the alarm switch communicates with the alarm module through wireless communication.

* * * * *